US005167192A

United States Patent [19]

Pingel et al.

[11] Patent Number: 5,167,192

[45] Date of Patent: Dec. 1, 1992

[54] DAMPER CONTROLLER FOR A CHEMICAL RECOVERY FURNACE

[75] Inventors: Kenneth A. Pingel, Hillsboro; Daniel R. Higgins, Portland, both of Oreg.

[73] Assignee: Anthony-Ross Company, Beaverton, Oreg.

[21] Appl. No.: 662,353

[22] Filed: Feb. 28, 1991

[51] Int. Cl.[5] ..... F23L 15/00

[52] U.S. Cl. ..... 110/182.5; 110/163; 266/266; 266/269

[58] Field of Search ..... 110/163, 297, 182.5; 266/266, 269; 134/6; 162/232, 272

[56] References Cited

U.S. PATENT DOCUMENTS

| | | | |
|---|---|---|---|
| 4,099,471 | 7/1978 | Sander et al. | 110/182.5 |
| 4,822,428 | 4/1989 | Goodspeed | 134/6 |
| 4,838,182 | 6/1989 | Goodspeed | 110/182.5 |
| 4,846,080 | 7/1989 | Ross et al. | 110/182.5 |
| 5,001,992 | 3/1991 | Higgins et al. | 110/182.5 |

*Primary Examiner*—Edward G. Favors

*Attorney, Agent, or Firm*—Dellett, Smith-Hill and Bedell

[57] ABSTRACT

A controller for a damper in a chemical recovery furnace relieves physical engagement between the damper mechanism and an operating handle therefor when such handle is being repositioned. The damper is repositioned to prevent interference with an adjacent port cleaner.

21 Claims, 7 Drawing Sheets

DAMPER CONTROLLER FOR A CHEMICAL RECOVERY FURNACE

BACKGROUND OF THE INVENTION

The present invention relates to chemical recovery furnaces and particularly to apparatus for controlling dampers adjacent ports where combustion air is introduced into the firebox of the furnace.

Wood pulp for paper making is usually manufactured according to the sulfate process wherein wood chips are treated with a cooking liquor including sodium sulfide and sodium hydroxide. The wood chips and the cooking liquor, called "white liquor", are cooked in a digester under predetermined heat and temperature conditions. After cooking, the used liquor, termed "black liquor", containing spent cooking chemicals and soluble residue from the cook, is washed out of the pulp and treated in a recovery unit where the cooking chemicals are reclaimed. Without reclamation and reuse of the cooking chemicals, the cost of the paper making process would be prohibitive.

In the recovery process, the black liquor is first concentrated by evaporation to a water solution containing about 65% solids, which solution is then sprayed into the firebox of a black liquor recovery boiler, a type of chemical reduction furnace. The chemical reduction furnace is a reactor wherein the processes of evaporation, gasification, pyrolysis, oxidation and reduction all occur interdependently during recovery of the cooking chemicals. The organic materials in the black liquor, lignin and other wood extracts, maintain combustion in the firebox, and the heat produced dries and melts the spent cooking chemicals as they fall to the floor of the firebox, where they build a mount of material called a char bed. The char bed is further heated to further liquefy the chemicals into a molten smelt that flows out of the furnace through a smelt spout to a collection tank. Concurrently, combustion heat is employed to generate steam in boiler tubes for use as process steam and for generating electricity.

The combustion process requires the introduction of large volumes of air into the firebox, air comprising about 80% of the material entering the firebox. The air is forced into the firebox from windboxes or ducts disposed at several levels in surrounding relation to the firebox, through a plurality of air ports in the walls of the furnace, viz.: primary, secondary and tertiary air ports. The primary air ports, through which about 40 to 50% of the air enters the furnace, are disposed on the sidewalls of the firebox near the bottom of the furnace close to the char bed. The secondary air ports, through which about 35% of the air enters the furnace, are disposed around the walls of the firebox, higher than the primary air ports, and closer to the entry conduits through which the black liquor is sprayed into the firebox. While the primary air ports provide a large volume of air with considerable turbulence for maintaining a fireball in the char bed, the secondary and tertiary air ports provide fine control and distribution of air above the char bed and distribute the air evenly in the black liquor spray.

The black liquor sprayed into the firebox, having a consistency similar to that of warm sixty weight oil, swirls, burns and falls toward the bottom of the firebox as combustion products comprising char material and smelt. The smelt and char material contact the outer walls of the firebox and, cooled by the inflowing air, form excrescent deposits around the edges of the air ports, particularly along the edges of the openings where the excrescent material builds up, and around the openings under influence of air rushing through the air port. Such build-up of char material can block the desired air flow and can even block individual ports completely. In accordance with customary practice, the char build-up is periodically removed by a worker inserting a rod into the air ports successively around the boiler. With manual rodding of the air ports, gradual build-up of char material intermittently around the furnace causes changes in the volume of combustion air, as well as changes in air distribution, velocity and pressure. Moreover, the manual rodding may not always remove as much of the char material as would be desired. Particularly hard deposits of solidified smelt and char material resembling a vitreous substance resist cleaning. Therefore, furnace operation often tends to be inefficient and unpredictable with an attendant decrease in the amount of chemical that can be recovered, a decrease of steam produced per unit of fuel, and increased emission of noxious gasses such as carbon monoxide and sulfur dioxide.

Much more satisfactory cleaning operation can be accomplished through the use of automatic powered apparatus positioned adjacent each air port for periodically ramming through the char build-up, for example, see Goodspeed U.S. Pat. No. 4,822,428 granted Apr. 18, 1989. Such apparatus employs a metal cleaning tip on the end of a rod wherein the rod is powered by a remotely controlled air cylinder. The mechanism indexes along the air port for the purpose of successively cleaning different areas thereof.

However, the primary air ports in some boiler installations are intentionally partially blocked by manually operated dampers located in the windbox adjacent the air ports and used for adjustably controlling air flow. These manually operated dampers are difficult to move from one position to another because of the appreciable air flow they control, and because of being constructed of fairly heavy material. Furthermore, the dampers adjacent primary air ports tend to remain in one position for long periods of time since fine air regulation is not required at the primary level. The dampers often become virtually immovable due to build-up of excrescent material.

The presence of dampers hinders hand rodding of primary air ports. Hand rodding may only be undertaken for the cross section of the air port which can be seen, i.e., that portion not covered by a damper, with resulting build-up of excrescent material adjacent the damper. Installation of power cleaning equipment such as described above is virtually prohibited by the presence of hand operated dampers since the dampers would need to be moved manually each time the power equipment is operated in order to avoid mechanical interference.

Totally automated cleaner-damper combinations have been employed, particularly at the secondary air port level. (See U.S. Pat. No. 4,838,182 and U.S. Pat. No. 4,846,080.) However, use of this type of equipment is not warranted at the primary level inasmuch as fine damper control is not required. Replacement of dampers in an existing boiler with costlier equipment represents an expense which may be unjustified at least from the standpoint of air control. A boiler user would obviously prefer to avoid major alteration of an existing boiler through replacement of equipment that normally performs its function. Indeed such replacement may not be possible without major shutdown and boiler remanufacture. Moreover, the dirtier environment at the primary level is not conducive to replacement of existing equipment with more complex apparatus as may be difficult to maintain.

SUMMARY OF THE INVENTION

It is accordingly an object of the present invention to facilitate installation of primary air port cleaners in a chemical recovery furnace with minimum impact on existing equipment.

It is another object of the present invention to enable installation of primary air port cleaners in an existing furnace with minimum expense.

It is a further object of the present invention to provide apparatus for enabling the installation of primary air port cleaners in a boiler utilizing conventional dampers.

It is another object of the present invention to provide means for facilitating adjustment of manual dampers adjacent primary air ports in a chemical recovery furnace.

In accordance with the present invention in a principal embodiment thereof, a controller for a damper in a chemical recovery furnace includes an actuator having a driving connection with the damper capable of moving the damper between relatively closed and relatively opened positions. A manually positionable stop is located for halting movement of this actuator at a selected point intermediate said relatively open and closed positions at which point a desired degree of air regulation is to be achieved. Means are further provided for energizing the actuator to move the damper between an out-of-the-way, at-rest position, and the air-regulating intermediate position. The actuator in the at-rest position is in non-engaging relation with the positionable stop.

The actuator places the damper in the at-rest position under two conditions: first, when the positionable stop is to be manually set, and second, when an adjacent air port cleaner (if provided) is to be actuated and it is desired the damper be moved away from interfering relation with the air port cleaner. The positionable stop is essentially disconnected from the damper and its actuator at such times as a manual adjustment needs to be made whereby such adjustment can be accomplished with virtually fingertip control.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

DETAILED DESCRIPTION

Figure 1:
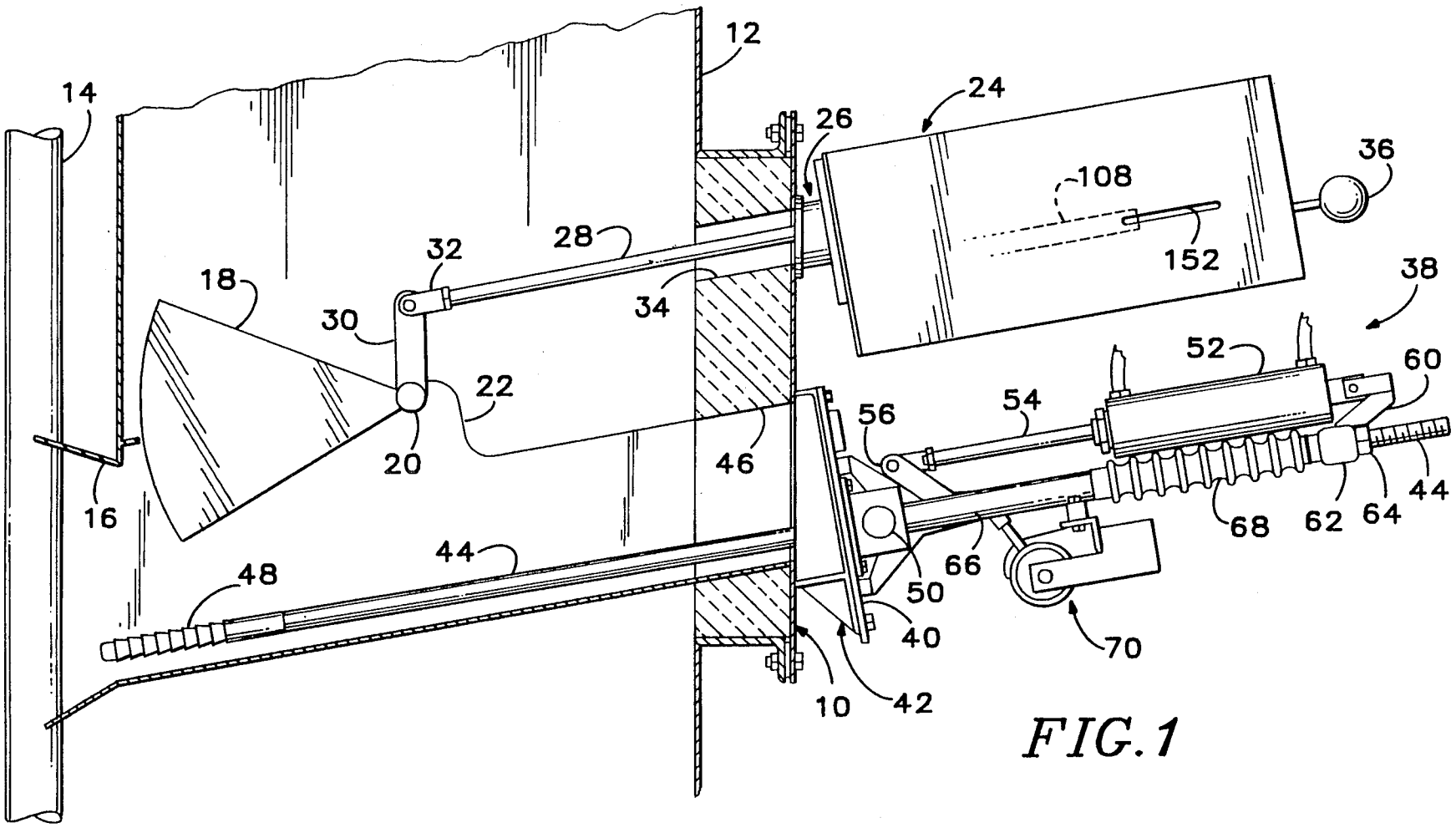
FIG. 1 is a vertical cross sectional view of the boiler windbox adjacent an air port leading to the firebox of a chemical recovery furnace, illustrating the adjacent installation of an air port cleaner and a damper controller according to the present invention, the said air port cleaner being in a first, retracted position.

Referring to FIG. 1, illustrating an overall installation of the damper controller according to the present invention in conjunction with an air port cleaner of the type described in Goodspeed U.S. Pat. No. 4,822,428, both these devices are mounted on a windbox face plate 10 of a windbox 12 of a chemical recovery furnace. Adjacent the windbox and within the firebox of the furnace are positioned a plurality of boiler tubes, one of which is illustrated at 14 in FIG. 1. An air port 16 is located for passing quantities of combustion air from the windbox and outwardly into the firebox between the boiler tubes.

A box-like damper 18, which is sector-shaped in vertical cross section, is normally pre-existing and mounted for rotation about damper pivot 20 extending from vertical inner wall 22 of the windbox. The combustion air passes vertically from the windbox via an entrance port not shown, and underneath the damper 18 toward air port 16. In the position shown for damper 18, the air passage is at least partially closed off, blocking the flow of air which could pass under the damper 18 if it were completely upraised (to the position shown in FIG. 2).

In accordance with the present invention, damper controller 24, as hereinafter more fully described, is mounted upon frame 26 in turn secured to windbox face plate 10. Damper actuator rod 28 is connected on one end to damper lever arm 30 by means of clevis 32 wherein the damper lever arm is effective for rotating damper 18 in either a clockwise or counterclockwise direction. Actuator rod 28 extends through access port 34 in the windbox face plate and through hollow frame 26 into controller 24 wherein the air-controlling position of the damper is determined via operating handle 36.

The damper control in accordance with the present invention is adapted to be employed in conjunction with an automatic air port cleaner of the general type set forth in the aforementioned Goodspeed U.S. Pat. No. 4,822,428. Such cleaner, illustrated at 38, is mounted on face place 40 supported from frame 42 upon windbox face plate 10 so that cleaning rod 44 extends through port 46 into windbox 12. The far end of the rod 44 is equipped with cleaning tip 48 used for cleaning air port 16 as hereinafter more fully described.

The rod 44 passes through pivot bearing 50 positioned over an aperture in face plate 40 and operable to enable pivoting of rod 44 and tip 48 in a vertical direction, i.e., up and down over substantially the vertical dimension of air port 16. Pivot bearing 50 and sleeve 66 slideably receive rod 44 so that it can be extended to the left in FIG. 1 whereby tip 48 is inserted into the air port in a direction longitudinal of rod 44. To accomplish rod extension, the apparatus 38 is equipped with an air cylinder 52 having a piston rod 54 pivotally mounted upon a bracket 56 extending angularly upwardly from member 66. The opposite end of the air cylinder 52 is pivotally mounted upon a bracket 60 which extends angularly upwardly from bar 62 receiving the threaded inner end of rod 44, rod 44 being engageable by nut 64 secured against bar 62. A portion of the rod 44 is covered by a boot or bellows 68 to prevent contamination thereof as it slides back and forth.

Figure 2:
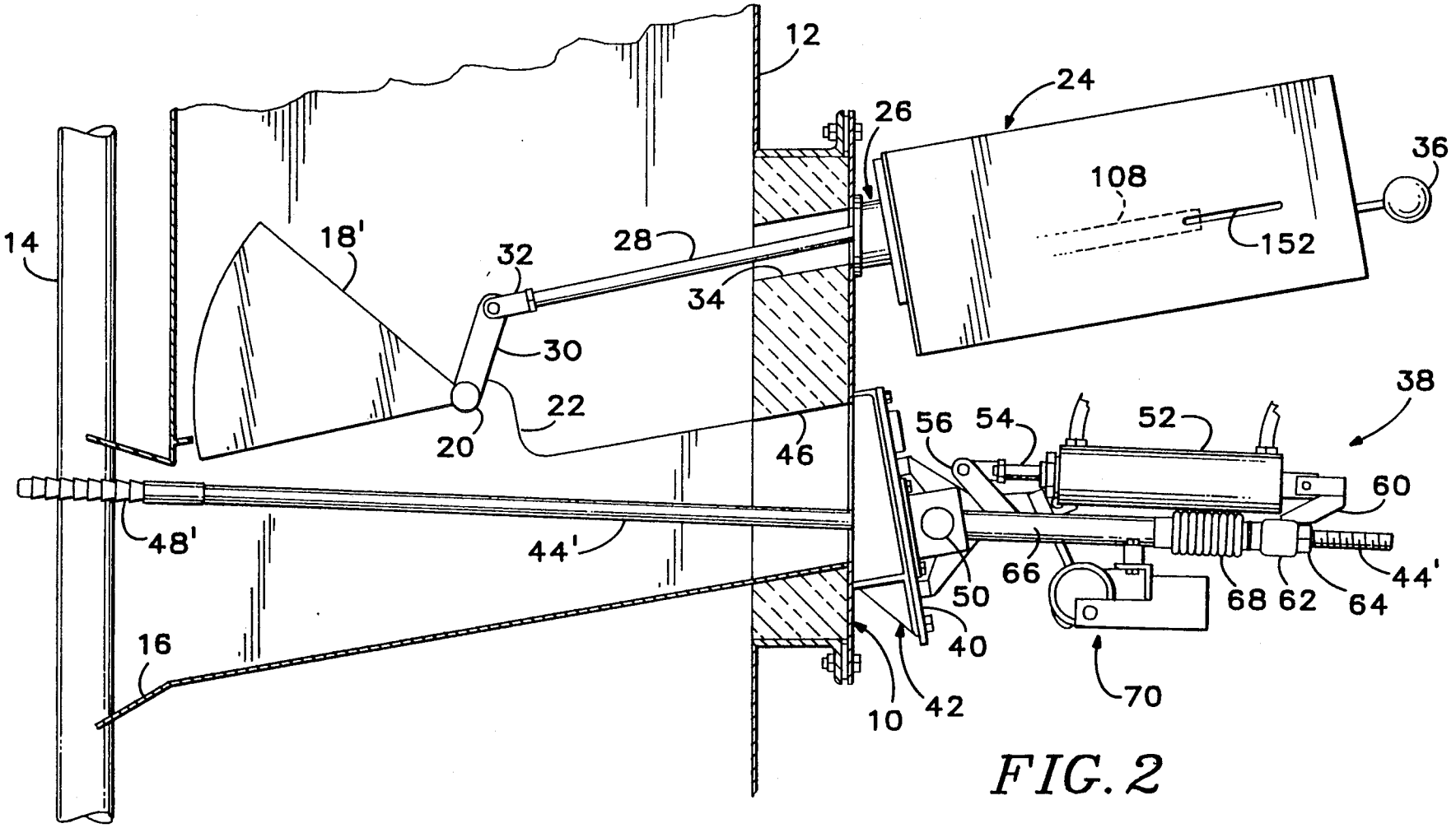
FIG. 2 is a similar vertical cross section of a windbox illustrating the cleaning apparatus extended into the air port while the adjacent damper is upraised so that it does not interfere with cleaner operation.

An eccentric mechanism 70 is adapted for indexing the rod 44 and its tip 48 to various angular positions about the axis of pivot bearing 50. Referring to FIG. 2, illustrating substantially the same subject matter as FIG. 1, the rod 44' is shown in a clockwise or upraised position, and is extended so that tip 48 protrudes outwardly through air port 16 between the boiler tubes. The eccentric mechanism 70 is capable of swinging the rod 44' whereby tip 48, having the approximate width of an air port, can clean the entire air port in the vertical direction. Typically the tip 48 will first be in a position withdrawn to the right as illustrated in FIG. 1 and will then be extended outwardly to the left so as to clean a portion of the air port. The tip 48 is withdrawn to the right again and indexed upwardly by mechanism 70 after which it can be extended once more to the left. Successive "ramming" operations, under control of air cylinder 52, are effective for cleaning the entire air port.

The damper 18 in FIG. 1 is illustrated as positioned adjacent the air port 16 for blocking a portion of the air flow as passes thereunder. However, in FIG. 2 the damper as illustrated at 18' is shown in a position rotated clockwise, i.e., withdrawn from the area immediately in front of the air port 16 for placing the damper in non-interfering relation with operation of rod 44' and tip 48' of the cleaner. For this purpose damper actuator rod 28 has been translated to the right in the drawing by means of controller 24, rotating lever arm 30 in a clockwise direction and rotating the damper out of the way, in this case to a fully-open position. When the cleaning apparatus 38 returns rod 44 to its resting position illustrated in FIG. 1, the damper 18 can be returned to the FIG. 1 damping position theretofore selected by handle 36.

Figure 3:
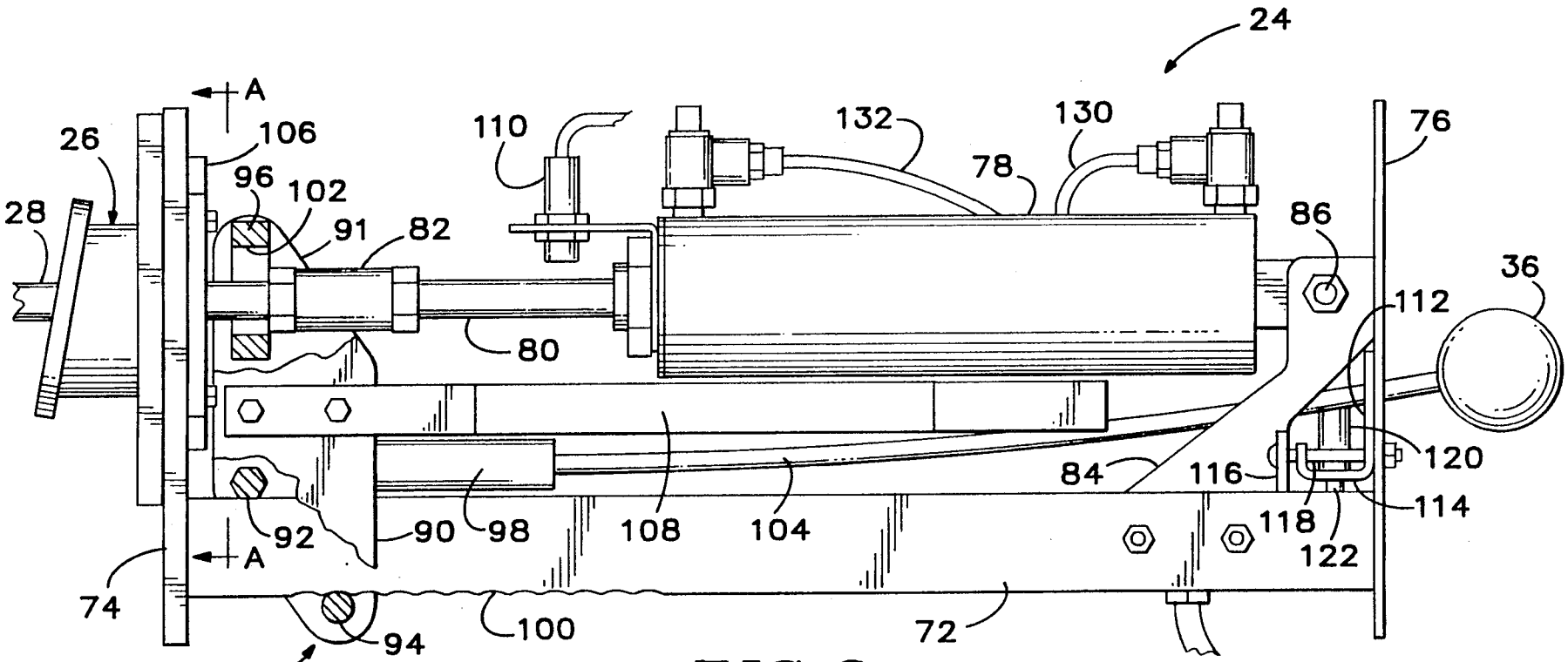
FIG. 3 is a side view, partially broken away, of a damper controller according to the present invention.
Figure 4:
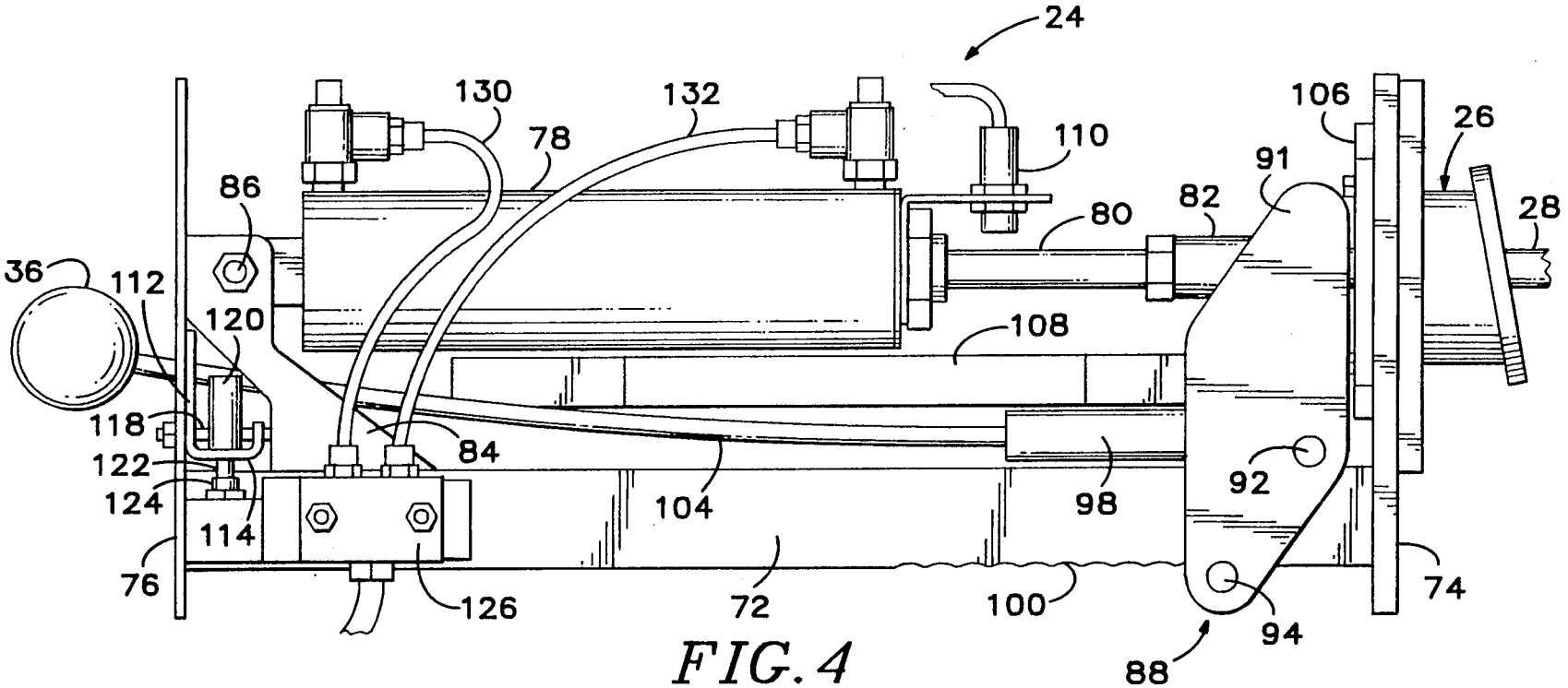
FIG. 4 is an opposite side view of damper controller according to the present invention.
Figure 5:
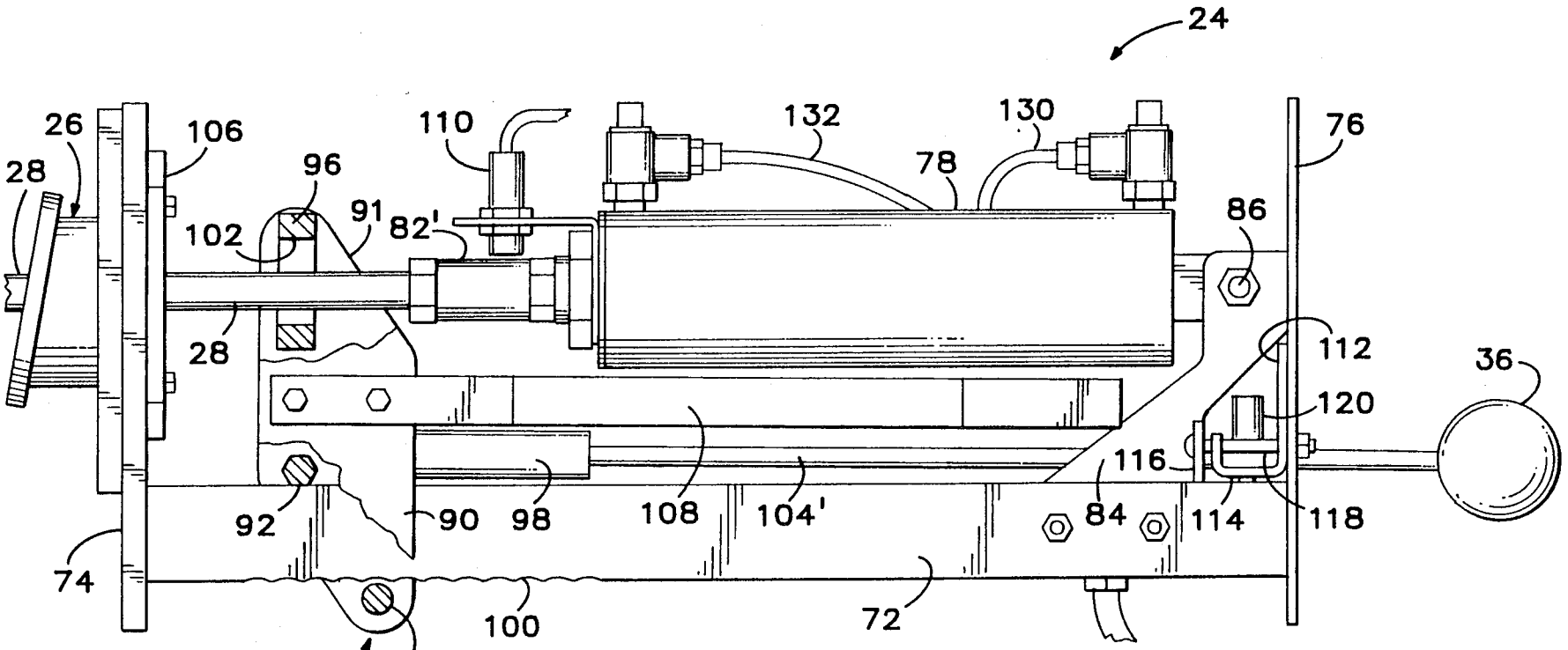
FIG. 5 is a side view, partially broken away, illustrating the damper controller according to the present invention in a position for retracting the damper rod and illustrating an intermediate position for the damper stop bracket.

Referring to FIGS. 3, 4 and 5, the damper controller 24 is illustrated with its metal cover removed. In the position for the apparatus depicted in FIGS. 3 and 4, the damper actuator rod 28 is extended so as to procure a selected degree of damping, while FIG. 5 illustrates the apparatus with the damper actuator rod 28 withdrawn, i.e., with the damper in open position. For the purposes of the present discussion, the damper open position will be referred to as the reference or at-rest position, with a desired degree of damping being selected with respect thereto.

The controller apparatus is mounted upon a tubular structural member 72 which is substantially rectangular in cross section for providing a chassis, to the ends of which are secured a forward mounting plate 74 attached to hollow frame 26, and a rear face plate 76 through which control rod 104 passes for mounting operating handle 36. A principal actuator in the form of an air cylinder 78 is pivotally connected via bolt 86 to bracket 84 extending angularly upwardly from chassis 72. Cylinder 78 is provided with a piston rod 80 joined by coupling 82 to the damper actuator rod 28 passing through hollow frame 26, plate 74, and an air seal housing 106, hereinafter more fully described. Damper actuator rod 28 is also extended through a vertically elongate aperture 102 in crossbar 96 of the movable stop bracket 88 wherein the aperture 102 permits vertical movement of the damper actuator rod 28 as the air cylinder 78 pivots around bolt 86 but the aperture 102 is narrow in the horizontal direction so as to form a stop for coupling 82. In FIG. 3, the piston rod 80 of the air cylinder 78 is illustrated as urging the coupling 82 against crossbar stop 96.

The crossbar 96 separates left and right parallel side plates 90 and 91 of stop bracket 88 having a spacing permitting the passage of coupling 82 therebetween. The side plates 90 and 91 are also separated by a spacer member 98 that extends rearwardly from the stop bracket 88, as well as by horizontal solid pins 92 and 94 wherein upper hexagonal cross section pin 92 is adapted to slide along the top of chassis 72, while lower circular cross section pin 94 is disposed underneath the chassis 72. For the disposition of the apparatus as illustrated in FIG. 5, the stop bracket at 88' is movable along chassis 72 under the control of operating handle 36 which is connected to spacer member 98 by flexible control rod 104'. The stop bracket at this time slides on pin 92. However, for the positions of handle 36 as illustrated in FIGS. 3 and 4, with the rod 104 flexed as illustrated, the stop bracket 88 is rotated in a counterclockwise direction (as viewed in FIG. 3) whereby lower pin 94 engages one of a plurality of parallel horizontal grooves 100 disposed across the bottom of chassis 72. Stop bracket 88 is thus locked in position in FIGS. 3 and 4.

Figure 8:
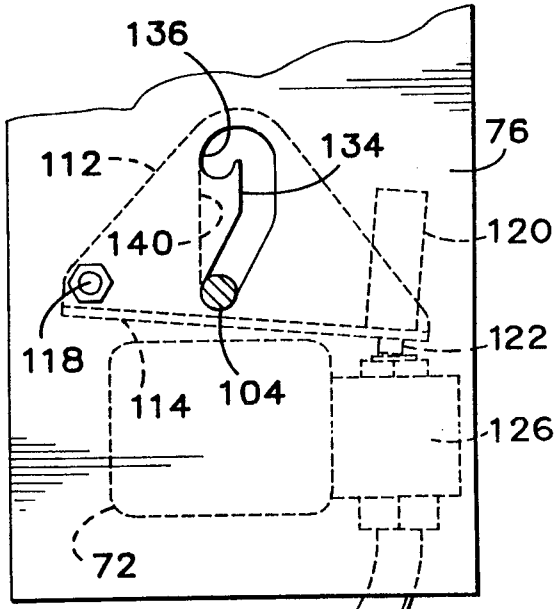
FIG. 8 is a forward view, partially broken away, illustrating the control rod in an unlocked lower position.
Figure 7:
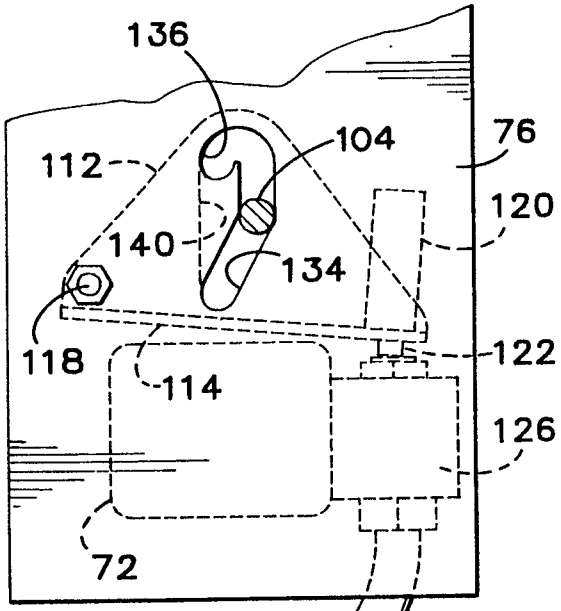
FIG. 7 is a forward view, partially broken away, illustrating the control rod in an unlocked, intermediate position.
Figure 6:
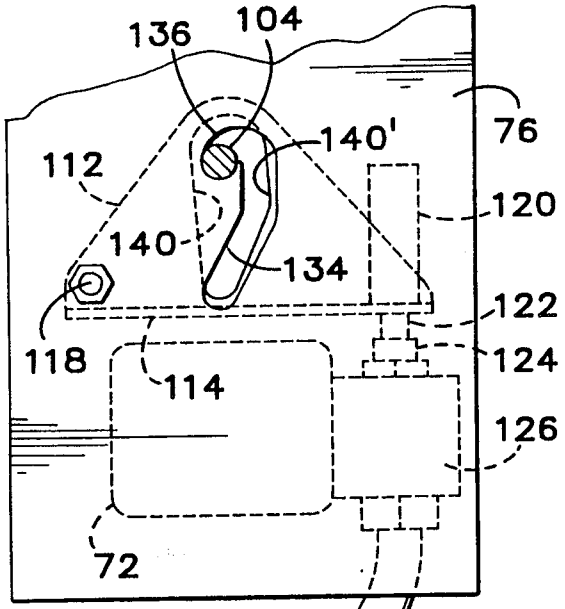
FIG. 6 is a forward view, partially broken away, illustrating the apparatus control rod in a locked position.

Referring now to FIGS. 6 through 8, a means of securing and maintaining the locked position is illustrated. Face plate 76 is provided with a generally vertical slot 134 through which flexible control rod 104 passes. The slot 134 is oriented diagonally, and then straight upwardly, ending in an upper, hooked portion 136 for accommodating rod 104 so that rod 104 may be raised into the hooked portion for maintaining its flexed attitude in FIGS. 3 and 4.

Immediately behind face plate 76, trigger bracket 112 is positioned for rotation about a bolt 118 extending between face plate 76 and vertical bracket 116. The trigger bracket 112 is J-shaped when viewed from the end thereof in FIGS. 3 and 5 for receiving bolt 118 at opposite sides of lower bracket portion 114. Lower portion 114 carries a spring biased plunger 120 having a tip 122 protruding downwardly from the trigger plate at the lower end of the trigger plate opposite bolt 118. The tip 122 is adapted for contacting operator 124 of solenoid valve 126.

Trigger plate 112 is further provided with a cam opening 140 through which rod 104 passes. Cam opening 140 is in approximate juxtaposition with slot 134 in face plate 76. For the downwardly titled (clockwise tilted) positions of trigger plate 112 as viewed in FIGS. 7 and 8, the cam aperture 140 matches the profile of slot 134 along the right hand side thereof as well as at its upper and lower extremities. However, the left hand side of cam opening 140 is substantially vertical as viewed in FIGS. 7 and 8 for joining its upper and lower portions.

With the trigger plate 112 in its "normal"position when rod 104 is locked (as seen in FIG. 6), the cam opening 140 is tilted to the left whereby its right contour appears through slot 134 at 140', the trigger plate 112 being biased to this position by the spring within plunger 120. It will be seen that when handle 36 is operated to remove rod 104 from its locked position, rod 104 will immediately engage the side 140' of the cam opening 140 and move the trigger plate 112 downwardly to the position shown in FIG. 7. The trigger plate maintains its clockwise positioning regardless of the location of rod 104, except when rod 104 is locked into hooked portion 136 of slot 134.

Figure 10:
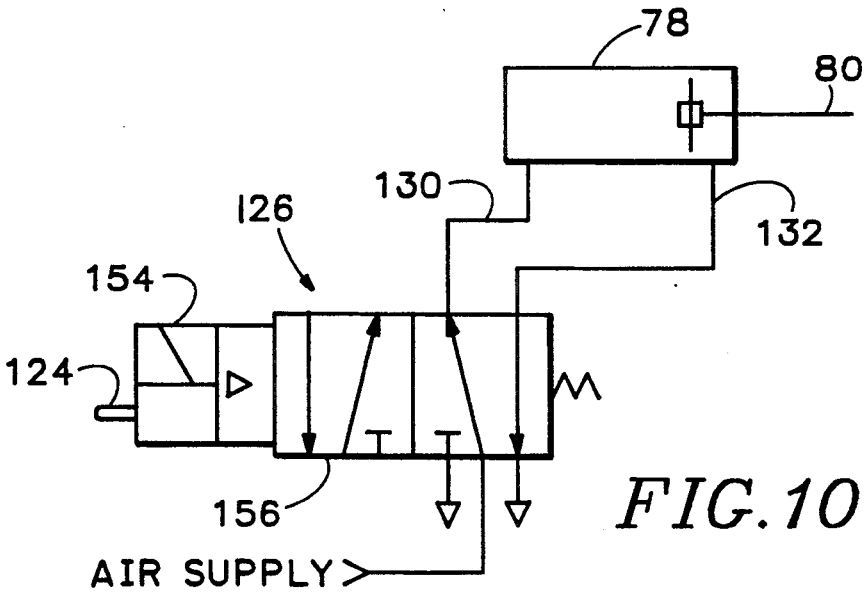
FIG. 10 is a diagram of a pneumatic circuit employed according to the present invention.

Returning to FIGS. 3, 4 and 5, and particularly to FIG. 4, solenoid valve 126, also shown schematically in FIG. 10, provides air pressure to opposite ends of air cylinder 78 by way of tubular connections 130 and 132. As long as the handle 36 is upraised in its locked position, air will be supplied via connection 130 for moving rod 128 to the right in FIG. 4 in order to secure a desired damping air controlling attitude. However, when handle 36 is employed to remove rod 104' from its locked position (as illustrated, for example, in FIG. 5), air is delivered through connection 132 for withdrawing rod 28 as a consequence of plunger 120 operating valve 126. The handle 36 can then be employed for sliding the stop bracket along chassis 72 to another position, for example to the position illustrated at 88' in FIG. 5. If the handle 36 in FIG. 5 is then upraised to a locked position, air pressure is restored to connection 130 and withdrawn from connection 132 whereby coupling 82' is forced to the left in FIG. 5, but no farther to the left than the position dictated by crossbar 96 of stop bracket 88'. Thus, a new damping position has been selected.

Reviewing operation according to the present invention, the controller will normally be in a "locked" condition as illustrated in FIGS. 3 and 4 whereby the damper will be disposed in operative relation to the air flow (for example, as illustrated in FIG. 1). For the position of the stop bracket 88 illustrated in FIGS. 3 and 4, the damper will be positioned substantially at its farthest point within the air flow (although it will be appreciated this will not necessarily be the usual case). Then, when it is desired to change the damper position, the operator grasps handle 36 and moves it slightly to the right out of the upper hooked portion of slot 134, and trigger plate 112 is engaged for operating the solenoid valve 126 and causing the cylinder 78 to withdraw piston rod 80 to the condition as illustrated in FIG. 5. Operation of cylinder 78 is immediate upon the flexible 104 being moved away from the hooked portion 136 of slot 134 so that pressure is immediately removed from crossbar 96 as would hinder manual movement of the stop bracket through moving handle 36 forwardly or backwardly. As illustrated in FIG. 5, the stop bracket can be easily moved by hand to a new position, and the operator does not have to contend with either the force of air cylinder 78 or the force of air flow which may impinge the damper itself. Moreover, the air cylinder 78 in moving the damper to a retracted position will have overcome any problems as may be presented by char deposits on the damper. Substantially "fingertip" control is afforded for repositioning the damper to the desired location. Indicator bar 108 carried by the stop bracket is viewable through slot 109 in the cover of controller 24 (see FIG. 1) so the operator can easily position stop bracket 88 to some intermediate location to afford the desired damping effect. Then, the handle 36 is upraised back to its locked position, i.e., with the rod 104 disposed in hooked portion 136 of slot 134, and air cylinder 78 causes piston rod 80 to extend whereby coupling 82 engages spacer bar 96 in its new location for repositioning the damper.

Not only is ease of positioning procured with the damper controller according to the present invention, but also coordination is easily provided between the damper and an automatic air port cleaner as illustrated in FIGS. 1 and 2. When the air port cleaner 38 is to begin a cycle of operation, the solenoid valve 126 is electrically operated by solenoid 154. A signal from the cycle timing apparatus (not shown), that periodically causes the air port cleaner 38 to function, also delivers an electrical signal to the solenoid 154. Thus, the spindle of the solenoid valve 126 is caused to move to the right as illustrated in FIG. 10 either through operation of trigger bracket mechanism 112, or in response to the cycling operation of the air port cleaner, whereby in either event the damper is moved to an "at-rest" position, fully open in the illustrated embodiments, in non-interfering relation with the cleaner apparatus. After the cleaner apparatus finishes its cleaning cycle, the air cylinder 78 returns to its position wherein coupling 82 is placed against crossbar 96 so that the selected degree of damping is restored.

Figure 9:
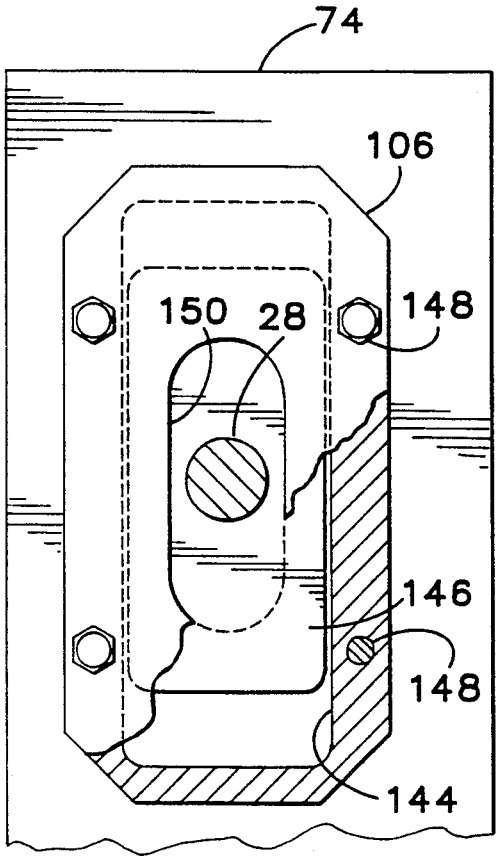
FIG. 9 is a cross sectional view, taken at A—A in FIG. 3, illustrating an air seal mechanism according to the present invention.

Referring to FIG. 9, the air seal housing is illustrated in greater detail. The air seal housing 106 comprises a cover plate, forwardly enclosing a cavity 144 within which slideable sealing member 146 is captured for movement in a vertical direction. The member 146 is suitably formed from Teflon sheet. Damper actuator rod 28 is matingly received through a central aperture in sealing member 146, but may move vertically with respect to an elongated vertical slot 150 in the air seal housing 106. Bolts 148 secure the air seal housing to plate 74. Thus, as cylinder 78 pivots with respect to bolt 86 (see FIG. 3) to accommodate varying damper positions, sealing member 146 can slide within cavity 144 while maintaining a substantial seal around actuator rod 28. It will be appreciated that a differential in air pressure exists between the two sides of the air seal housing and it is desired to prevent leakage into the controller.

Sensor 110 (see FIG. 5) is employed to detect the position of coupling 82, e.g. for safety reasons. Control circuitry (not shown) can be utilized to prevent operation of an adjacent automatic air port cleaner until the sensor 110 detects for certain that the air cylinder 78 has removed the damper out of the way.

It will be readily appreciated that the damper controller according to the present invention can be installed in an existing boiler without removing the damper. The damper controller is merely connected to the existing damper actuating rod, or to an extension or replacement thereof. Damper operation is greatly facilitated, as is installation of an adjacent air port cleaner.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A controller for a damper adapted for use in a chemical recovery furnace, wherein said damper is positionable to regulate air flow, said controller comprising:

an actuator having a driving connection with said damper and capable of moving said damper between relatively opposite positions for governing said air flow, a positionable stop for halting movement of said actuator at a position of said damper intermediate said relatively opposite positions, and means for energizing said actuator between an at-rest condition and said intermediate position for said damper, said positionable stop being disengaged in the at-rest condition of said actuator to facilitate setting of said positionable stop.

2. The controller according to claim 1 including means for setting the location of said positionable stop, wherein said means for energizing said actuator is responsive to said setting means for moving said actuator to said at-rest condition during operation of said setting means.

3. The controller according to claim 1 wherein said at-rest condition corresponds to a relatively open position for said damper.

4. The controller according to claim 1 in combination with an air port cleaner mechanism for cleaning a furnace air port, wherein said means for energizing said actuator is coordinated in operation with actuation of said cleaner mechanism for causing said actuator to move said damper away from said intermediate position and permit operation of said cleaner mechanism by placing said actuator in said at-rest condition, said damper in said at-rest condition of said actuator being disposed in non-interfering relation with said cleaner mechanism.

5. A controller for a damper adapted for use in a chemical recovery furnace wherein said damper is positionable to regulate the air flow from the furnace windbox to an air port communicating with said furnace, said damper having a positioning rod, said controller comprising:

a linear actuator having a driving connection with said positioning rod and capable of extending and retracting said rod to move said damper between relatively closed and relatively open positions in governing said air flow, a movable stop located adjacent said positioning rod for determining an intermediate position of said damper by halting movement of said rod when the damper reaches said intermediate position, means for setting the position of said movable stop, and means for energizing said linear actuator between an at-rest position and said intermediate position for said damper.

6. The controller according to claim 5 in combination with an air port cleaner mechanism located there adjacent for cleaning said air port, wherein said means for energizing said linear actuator is coordinated in operation with actuation of said cleaner mechanism for causing said linear actuator to move said damper away from said intermediate position and permit operation of said cleaner mechanism by placing said actuator in said at-rest position, said damper in said at-rest position of said actuator being disposed in non-interfering relation with said cleaner mechanism.

7. The controller according to claim 5 wherein said means for setting the position of said movable stop comprises a manually operable handle.

8. The controller according to claim 7 wherein said means for energizing said linear actuator is responsive to said position setting means for moving said actuator to said at-rest position.

9. The controller according to claim 8 wherein said at-rest position corresponds to the relatively open position of said damper.

10. The controller according to claim 5 wherein said rod is provided with an abutment for engaging said movable stop for the intermediate position of the damper.

11. A controller for a damper adapted for use in a chemical recovery furnace, wherein said damper is positionable to regulate the air flow from the furnace windbox to an air port communicating with the furnace, said controller comprising:

a damper actuator, means providing a driving connection from said actuator to said damper, means for energizing said actuator for movement in first and second opposite directions, and means for limiting the extent of movement of said actuator when energized for movement in said first direction according to selection of a position for said damper, said actuator being actuable in said second direction for enabling reselection of the position for said damper.

12. The controller according to claim 11 in combination with means for cleaning said air port, said actuator also being actuable in said second direction in response to operation of said means for cleaning said air port.

13. The controller according to claim 11 wherein said limiting means is adapted for hand operation.

14. The controller according to claim 13 wherein said actuator is actuable in said second direction in response to hand operation of said limiting means.

15. The controller according to claim 14 wherein said limiting means comprises a slideable stop engageable with said means for providing a driving connection when said actuator is moved in said first direction, and further comprising an operating handle having a rod communicating with said slideable stop for sliding said stop relative to said means for providing a driving connection.

16. The controller according to claim 5 further comprising a chassis member along which said stop is slideable, said stop comprising a frame member having horizontal pins extending above and below said chassis member, wherein said operating handle is adapted to flex said rod to cause firm engagement between said pins and said chassis member by rotation of said stop about said pins.

17. The controller according to claim 16 wherein said chassis member is provided with grooves for engaging one of said pins when said stop is rotated.

18. The controller according to claim 15 further including locking means comprising a member provided with a slot receiving said rod in a hooked portion of said slot when said rod is flexed for locking said stop, and cam means responsive to movement of said rod out of said hooked portion of said slot for bringing about movement of said actuator in said second direction so that said handle can be readily moved in a direction for sliding said stop.

19. The controller according to claim 18 further comprising a chassis member along which said stop is slideable, said stop being rotatable into locking engagement with said chassis member as said rod is received in said hooked portion of said slot.

20. A controller for a damper in a chemical recovery furnace, wherein said damper is positionable to regulate the air flow from the furnace windbox to an air port communicating with the furnace, said controller comprising:

actuator means for moving said damper relative to said air flow, adjustable stop means for limiting movement by said actuator means, and means for removing said actuator means from engaging relation with said stop means while said stop means is being adjusted, and then returning said actuator means to engaging relation with said stop means.

21. A controller for a damper in a chemical recovery furnace, wherein said damper is positionable to regulate the air flow from the furnace windbox to an air port communicating with the furnace, said controller comprising:

manually operable means, means for providing a positioning connection between said manually operable means and said damper for locating said damper, and means for relieving said connection to facilitate movement of said manually operable means, including means for changing the location of said damper to a neutral position during movement of said manually operable means.

* * * * *

UNITED STATES PATENT AND TRADEMARK OFFICE

CERTIFICATE OF CORRECTION

PATENT NO. : 5,167,192

DATED : December 1, 1992

INVENTOR(S) : Kenneth A. Pingel; Daniel R. Higgins

It is certified that error appears in the above-identified patent and that said Letters Patent is hereby corrected as shown below:

Column 8, line 1, "slot 109" should read --slot 152--.

Column 10, line 50, "claim 5" should read --claim 15--.

Signed and Sealed this

Twenty-first Day of December, 1993

*Attest:*

Bruce Lehman

BRUCE LEHMAN

*Attesting Officer*

*Commissioner of Patents and Trademarks*